United States Patent [19]

Klinger et al.

[11] 4,443,363

[45] Apr. 17, 1984

[54] DETERGENT COMPOSITION FOR CLEANING HARD SURFACES AND METHOD OF USING THE SAME

[75] Inventors: Wolfgang Klinger, Altötting; Eckhard Milewski, Kriftel, both of Fed. Rep. of Germany

[73] Assignee: Hoechst Aktiengesellschaft, Fed. Rep. of Germany

[21] Appl. No.: 330,767

[22] Filed: Dec. 14, 1981

[30] Foreign Application Priority Data

Dec. 23, 1980 [DE] Fed. Rep. of Germany ..... 3048642

[51] Int. Cl.[3] ..... C11D 1/38

[52] U.S. Cl. ..... 252/547; 252/106; 252/122; 252/156; 252/528; 252/DIG. 10; 134/42

[58] Field of Search ..... 252/547, 174.21, DIG. 14, 252/106, 156, 158, DIG. 10, 528, 122

[56] References Cited

U.S. PATENT DOCUMENTS 4,174,304 11/1979 Flanagan ..... 252/524
4,284,532 8/1981 Leikhim et al. ..... 252/528

FOREIGN PATENT DOCUMENTS 154418 4/1948 Australia .
2523588 5/1975 Fed. Rep. of Germany .
873214 7/1961 United Kingdom .
1488108 10/1977 United Kingdom .

*Primary Examiner*—John E. Kittle
*Assistant Examiner*—Jose G. Dees
*Attorney, Agent, or Firm*—Connolly and Hutz

[57] ABSTRACT

A detergent composition is described which is particularly suitable for the mechanical cleaning of hard surfaces, in particular glass, porcelain and the like, in a cleaning liquor which is within the alkaline range. This detergent composition is composed of (A) a nonionic surfactant selected from the group comprising polyalkylene glycol monoalkyl ethers containing ethylene oxide and propylene oxide units, polyglycol ether formals containing ethylene oxide units and, if appropriate, propylene oxide units, or polyalkylene glycol dialkyl ethers containing ethylene oxide units and, if appropriate, propylene oxide units, and (B) a selected quaternary ammonium compound as a cationic surfactant.

These compositions are particularly suitable for industrial crockery and bottle washing plants which are operated within the highly alkaline pH range and with vigorous mechanical agitation of the liquor.

9 Claims, No Drawings

DETERGENT COMPOSITION FOR CLEANING HARD SURFACES AND METHOD OF USING THE SAME

The invention relates to a detergent composition for the mechanical cleaning of hard surfaces, in particular bottles and crockery, in a cleaning liquor which is within the alkaline to highly alkaline range.

Nowadays, mechanical cleaning processes are extensively used for cleaning bottles and other objects having hard surfaces, such as crockery made of porcelain, ceramics, glass or plastics, and also other glass or metal objects. Whereas in the case of domestic dishwashing machines, only a relatively gentle agitation of the liquor is necessary, corresponding to the low throughput of material to be cleaned, commercial and, in particular, industrial cleaning plants operate at a high throughput rate, with very considerable agitation of the liquor and intensity of spraying. Owing to the higher loading of soil, this sets stringent requirements for the quality of the surfactant-containing cleansing agent employed, in respect of its cleansing power, soil uptake capacity and wetting power. In order to ensure the necessary rapid removal and emulsification of the adhering impurities, it is customary to carry out the process in highly alkaline liquors in commercial cleaning plants of this type and, in particular, in industrial cleaning plants. Owing to the considerable mechanical agitation of the liquor, the system must also have as low a foam content as possible, or be free from foam, since excessive foam formation can lead to interruptions in the performance of the plant, for example if the soil accumulating in the layer of foam cannot be discharged to an adequate extent. Additional tendencies to the formation of foam are caused by the impurities brought into the liquor by the material to be cleaned, particularly by protein-containing residues on the material to be cleaned. In the case of bottle cleaning, this also applies particularly to the labels which have to be removed and which are responsible for introducing into the cleaning liquor residues of glue and of printing inks, including the surfactant auxiliaries contained in the latter.

It is known to employ nonionic surfactants having low-foaming characteristics as cleaning agents for hard surfaces in alkaline baths. These are, in particular, addition reaction products of ethylene oxide and/or propylene oxide with amines, fatty alcohols or alkylphenols having a fairly long chain or polyglycol ether formals or acetals, or block copolymers of ethylene oxide and propylene oxide. Surfactant systems of this type can be formulated, in particular by suitably varying the proportions of ethylene oxide and propylene oxide, to have as low a tendency to foaming as possible and an increased cleaning action, an excess of propylene oxide favoring the first property, while an excess of ethylene oxide favors the latter property. However, such a formulation of these properties always represents a compromise, and it would be desirable to obtain more of the first property without having to dispense with a fraction of the second property. Although, in the case of mechanized cleaning processes for bottles, crockery and the like in the industrial sector, which are carried out with considerable mechanical agitation, the low foam content of the surfactant systems mentioned is very desirable, the removal of soil in the short time of throughput available for the material to be cleaned, and also the soil uptake capacity, are frequently not adequate and are in need of improvement.

Attempts have already been made to compensate for this disadvantage by means of specific mixtures belonging to the said categories of nonionic surfactants, as described in German Auslegeschrift No. 2,723,139. Although such mixtures have an advantageously low tendency to foaming at the higher operating temperature of the plant, they have too high a tendency to foaming at lower temperatures, which is disadvantageous when charging and heating up the plant. Recourse to anionic surfactants, which would increase the cleaning and wetting power, is hardly possible, since this will increase the tendency to foaming too greatly. Attempts have also already been made, for disinfecting purposes, to include, in the bottle cleaning agents, cationic surfactants having long alkyl chains. This is described in German Offenlegungsschrift No. 2,449,354, in which the cationic surfactants employed are quaternary ammonium salts containing one or two long-chain alkyl radicals or alkylaryl radicals in the molecule, as well as short-chain radicals. Since this type of cationic surfactant has a tendency to relatively severe formation of foam, it is also necessary to add an antifoaming agent, orthophosphoric acid monoalkyl esters being envisaged for this purpose in this text. In some cases, nonionic surfactants can also be present in the mixture. However, formulations of this type, which include cationic quaternary ammonium compounds containing at least one long alkyl chain, have the decisive disadvantage that the said compounds are absorbed substantively onto the material to be cleaned. This prevents the liquid from flowing off smoothly; drops are formed and these then leave behind troublesome rings as the material dries. This effect, which is very desirable when the products are used as a fabric after-treatment agent for textiles, makes the use of the said quaternary ammonium compounds in crockery and bottle cleaning agents in alkaline liquors very problematical. Also, if the said quaternary ammonium compounds are employed as a mixture with nonionic surfactants, as is similarly described in German Offenlegungsschrift No. 2,449,354 and also in German Offenlegungsschrift 2,523,588, no appreciable increase in the soil uptake capacity of the nonionic component is achieved.

The problem has therefore arisen of improving the soil uptake capacity of such mixtures without having to accept the disadvantage of substantivity.

In accordance with the invention, this aim is achieved by means of a detergent composition which is composed of:

(A) 20 to 95% by weight of a nonionic surfactant of the formula

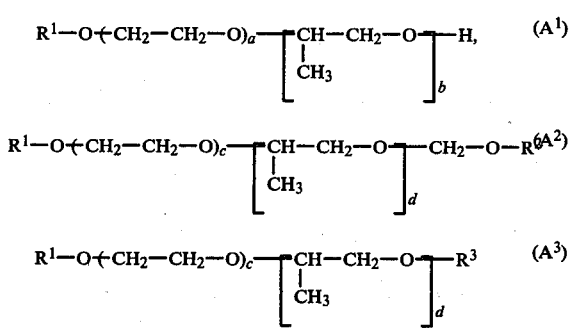

$$R^1-O-(CH_2-CH_2-O)_a-[CH(CH_3)-CH_2-O]_b-H, \quad (A^1)$$

$$R^1-O-(CH_2-CH_2-O)_c-[CH(CH_3)-CH_2-O]_d-CH_2-O-R^6 \quad (A^2)$$

$$R^1-O-(CH_2-CH_2-O)_c-[CH(CH_3)-CH_2-O]_d-R^3 \quad (A^3)$$

or of a mixture of the formulae ($A^1$), ($A^2$) and/or ($A^3$), in which $R^1$ is an alkyl radical having 6 to 18 C atoms, $R^2$ is an alkyl radical having 1 to 4 C atoms, $R^3$ is an alkyl radical having 1 to 4 C atoms, a is a statistical average value within the range from 3 to 6, b is a statistical average value within the range from 3 to 5, c is a statistical average value within the range from 6 to 12 and d is a statistical average value within the range from 0 to 3, and (B) 5 to 80% by weight of a cationic surfactant of the formula

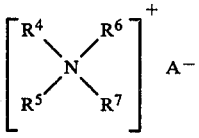

in which $R^4$, $R^5$ and $R^6$ are identical or different and are alkyl radicals having 1 to 8 C atoms and $R^7$ is an alkyl radical having 1 to 4 C atoms or a benzyl radical and A denotes an anion.

The effectiveness of these agents for the mechanical cleaning of crockery, bottles and other glass objects, or metals, in alkaline cleaning liquors, in particular also in the highly alkaline cleaning liquors used in the industrial sector, is based on the surprising finding that the inclusion, as the cationic component, of quaternary ammonium compounds containing exclusively short to average chains in the molecule, makes it possible to improve considerably the soil uptake capacity of such compositions these cationic surfactants, within the alkaline range, not being absorbed substantively, for practical purposes, onto the material to be cleaned, and that, moreover, such agents have, at the same time, an advantageously low tendency to foaming both at elevated temperatures and at low temperatures.

The nonionic surfactants (A) employed as a constituent are known. These are:

($A^1$) addition reaction products of alcohols having 6 to 18 carbon atoms with ethylene oxide and propylene oxide, these ethylene oxide and propylene oxide units being present in the form of blocks and at least part, preferably all, of the propylene oxide being added by condensation after the addition reaction of the ethylene oxide. Condensation products of this type are known, for example from German Auslegeschrift No. 1,135,122, in particular from their use in washing agents for textiles. They correspond to the general formula

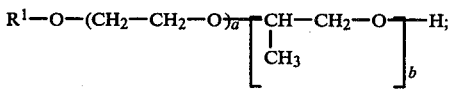

in which $R^1$ denotes an alkyl radical having 6 to 18 C atoms, preferably 7 to 14 C atoms, a denotes a statistical average value within the range from 3 to 6, preferably 3.5 to 5.5 and b denotes a statistical average value within the range from 3 to 5, preferably 3.5 to 4.5. Such an average value can be a whole or fractional number. The ratio of ethylene oxide to propylene oxide units should preferably be within the range from 0.8 to 1.5.

They are also:

($A^2$) polyglycol ether formals of the general formula

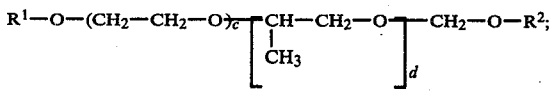

these formals contain ethylene oxide units and, if appropriate, propylene oxide units, it being possible, in the event that both are present, for these units to be distributed statistically or to be incorporated as blocks. Such polyglycol ether formals can be prepared, for example, from the corresponding polyglycol ethers, alcohols and formaldehyde, as described in German Offenlegungsschrift 2,523,588. In the said formula, $R^1$ denotes an alkyl radical having 6 to 18 C atoms, preferably 8 to 14 C atoms, $R^2$ denotes an alkyl radical having 1 to 4 C atoms, preferably the n-butyl radical, c denotes a statistical average value within the range from 6 to 12, preferably 6 to 10, and d denotes a statistical average value within the range from 0 to 3, preferably 0.

Finally, the nonionic component can also be ($A^3$), a polyalkylene glycol dialkyl ether of the formula

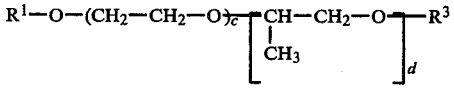

which contains ethylene oxide units and, if appropriate, propylene oxide units, which can be arranged in a statistical distribution or in blocks. In this formula, $R^1$ denoes an alkyl radical having 6 to 18 C atoms, preferably 8 to 14 C atoms, $R^3$ denotes an alkyl radical having 1 to 4 C atoms, preferably the tert.-butyl radical, c denotes a statistical average value within the range from 6 to 12, preferably 7 to 10, and d denotes a statistical average value within the range from 0 to 3, preferably 0.

The abovementioned nonionic surfactants can also be present in the form of mixtures of products within the groups ($A^1$), ($A^2$) or ($A^3$) or else mixtures between the groups ($A^1$), ($A^2$) and/or ($A^3$). The nonionic surfactants preferably belong to group ($A^1$).

The cationic component present in the detergent composition is a quaternary ammonium compound (B) of the formula

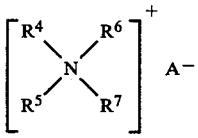

in which $R^4$ and $R^5$ are identical or different and denote an alkyl radical having 1 to 8 C atoms, preferably 4 to 6 C atoms, $R^6$ denotes an alkyl radical having 1 to 8 C atoms, preferably 1 to 6 C atoms, and $R^7$ denotes an alkyl radical having 1 to 4 C atoms or a benzyl radical. A is an anion, preferably a chloride or bromide anion or an anion of the formula $CH_3OSO_3^-$. The proportion of compounds of the detergent composition is of considerable importance for its advantageous properties. In order to achieve the required optimum combination of soil uptake capacity, minimum tendency to foaming and virtually non-substantive behavior, the ratio of the components A:B should be within the range from 20:80 to 95:5% by weight, preferably 40:60 to 85:15% by weight.

The detergent compositions can be employed as a mixture of the components A+B in an undiluted, liquid form. However, for the sake of better meterability, for example, they can also be used in the form of aqueous concentrates, if appropriate with the addition of an organic solvent also. It is also possible, of course, to add the components A and B separately to the aqueous cleaning liquor.

The concentration for use is appropriately 0.05 to 10 g of the mixture A+B per liter of cleaning liquor, preferably 0.1 to 2 g per liter. The concentrations for use which have been mentioned are non-critical figures, since the quantity depends to a certain extent on the nature of the surface to be cleaned and on the nature and extent of the impurities.

Further additives and auxiliaries can be mixed into the detergent compositions according to the invention, if appropriate when commercial formulations are prepared. These are, for example, dyestuffs, perfumes, corrosion inhibitors and disinfectants. Particular mention should also be made here of the known builders, which are in some cases complex-forming agents at the same time. Suitable examples of these are the condensed phosphates, such as tripolyphosphates and, in particular, pentasodium triphosphate. These are also complex-forming aminopolycarboxylic acids and salts thereof, such as, above all, alkali metal salts of nitrilotriacetic acid and of ethylenediaminetetraacetic acid, and also complex-forming hydroxycarboxylic acids and polymeric carboxylic acids, such as citric acid, tartaric acid and the like. A further class of complex-forming builders is constituted by salts of polyphosphonic acids, such as, for example, the alkali metal salts of aminophosphonic acid. Finally, it is also possible to add builders such as silicates, for example sodium metasilicate, carbonates, bicarbonates, borates and citrates. The detergent compositions according to the invention can, if appropriate, be converted into the form of powder with the aid of such additives and can also be used in this form.

The detergent compositions according to the invention are suitable for the mechanical cleaning of hard surfaces in alkaline liquors. This applies to cleaning in domestic dishwashing machines and so-called commercial cleaning plants. However, the compositions are particularly suitable for industrial cleaning plants for hard surfaces, for example plants for washing crockery and bottles, which operate continuously with considerable mechanical agitation of the liquor and in highly alkaline liquors at pH values of $\geqq 10$, preferably $\geqq 12$.

The necessary alkaline additives, for the highly alkaline pH range of the liquor, preferably sodium hydroxide or potassium hydroxide, can be dissolved in the aqueous cleaning liquor before introducing the detergent composition according to the invention. However, they can also be added direct to the detergent composition and can be metered in together with the latter. The alkaline agent is appropriately added in the form of powder, flakes or pellets.

As well as the high stability towards alkali which is required for this purpose, the compositions according to the invention exhibit the low tendency to foam formation which is indispensable for industrial cleaning plants; as a rule this makes it superfluous to add additional antifoaming agents. Only in the case of extremely vigorous agitation of the liquor or if the soil present has an extremely high tendency to foam formation, can it be appropriate to add foam-inhibiting agents, which must exhibit the necessary stability towards alkalis. Examples of these are orthophosphoric acid esters, ethylenediamine condensation products with ethylene oxide and propylene oxide, and also fatty alcohols.

As cleaning agents for the mechanical cleaning of hard surfaces, in particular in respect of the stringent requirements set in industrial cleaning plants, the detergent compositions according to the invention also exhibit, in addition to the advantages already mentioned, the following important advantages: the compositions are not only stable towards alkali, but are also stable for long periods of time when stored together with alkalis. They have an extremely low tendency to foam formation, not only at the working temperatures of such cleaning plants, that is to say at temperatures above about 40° C., but also at low temperatures, so that, when the plants are refilled with cold water and heated up, there is no formation of troublesome foam which can then result in foaming over or interruptions to the circulation of the plant. The excellent soil uptake capacity permits a long service life in the plant until the latter is refilled, without the cleaning action being impaired. The good wetting power and run-off behavior make possible rapid removal of soil and thus a high throughput of material to be cleaned. Freedom from spots and streaks, and also high gloss of the cleaned material are also ensured. This makes the compositions according to the invention extremely suitable, for example, for cleaning bottles in breweries, and ensures, additionally, that, when the cleaned bottles are filled with foaming beverages, the latter are not impaired by collapse of the foam.

Within the scope of the end use of the detergent compositions according to the invention, "articles having a hard surface" are to be understood here principally as all kinds of crockery and bottles made of glass, porcelain, ceramics and plastics, and also other objects made of the said materials or made of metals.

The invention is illustrated by means of the following examples:

The components which follow are present in the detergent compositions employed in the following examples ($C_{7-11}$ etc. denotes a cut of $R^1$ within the range mentioned):

Nonionic surfactants of the formula $A^1$):

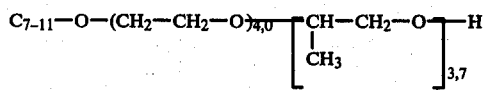
(a)

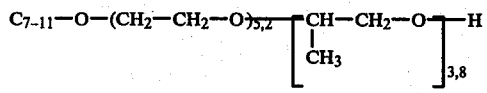
(b)

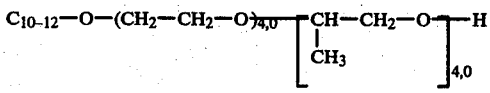
(c)

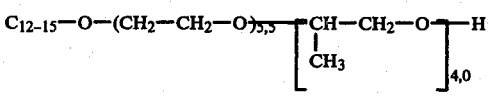
(d)

Nonionic surfactants of the formula $A^2$):

(e) $C_{10-12}—O—(CH_2—CH_2—O)_9—CH_2—O—n—C_4H_9$ (f) $C_{10-18}—O—(CH_2—CH_2—O)_{11}—CH_2—O—n—C_4H_9$

Nonionic surfactants of the formula $A^3$):

(g) $C_{10-12}—O—(CH_2—CH_2—O)_{10}—tert.—C_4H_9$ (h) $C_{10-14}—O—(CH_2—CH_2—O)_7—tert.—C_4H_9$ Quaternary ammonium compounds of the formula B (i) Dibutyldimethylammonium chloride (j) Tetrabutylammonium chloride (k) Dioctyldimethylammonium chloride (l) Dihexyldimethylammonium chloride The following compositions of the surfactants a to l are employed in the examples:

Example 1: 30% by weight of component c+70% by weight of component k

Example 2: 40% by weight of component a+30% by weight of component j+30% by weight of component k Example 3: 60% by weight of component b+30% by weight of component j+10% by weight of component k Example 4: 80% by weight of component d+20% by weight of component i Example 5: 30% by weight of component e+70% by weight of component i Example 6: 75% by weight of component f+20% by weight of component j+5% by weight of component i Example 7: 20% by weight of component g+80% by weight of component j Example 8: 85% by weight of component h+15% by weight of component i Example 9: 50% by weight of component c+50% by weight of component i Example 10: 55% by weight of component h+45% by weight of component l The following properties are determined for the said compositions (all the determinations are carried out on cleaning liquors which contain 1.5 g of surfactant composition A+B per liter and which have been adjusted to a pH value of 13 with NaOH):

(α) The foaming behavior of the detergent composition in an aqueous alkaline solution as specified in DIN 53,902 at 25° and 65° C. (columns 2 and 3 in the table).

(β) Determination of the soil uptake capacity

The soil uptake capacity is determined by testing the tendency to foaming in the presence of soil, by adding a test foamer to the cleaning liquor. The test foamer used is a wheaten beer (Export-Weizenbier made by Klosterbrauerei Raitenhaslach-Burghausen) in a concentration of 6% by weight in the liquor. The tendency to foaming of this liquor is determined at 65° C. under conditions of whipped foam as specified in DIN Standard Specification 53,902 (column 4 in the table).

(γ) Testing the run-off behavior in cleaned bottles 100 ml of the cleaning liquor is put into clean 0.5 l beer bottles, which are closed with a cork stopper and shaken vigorously five times. After a short dwell time (approx. 1 minute) the shaking process is again repeated five times and the surfactant-containing cleaning liquor is then poured out. The bottles are then rinsed four to five times successively, using 100 ml of distilled water each time, until a pH of 7 is reached.

Visual observation of the run-off behavior on the inner wall of the bottles: formation of drops indicates substantivity on the walls of the bottles (column 5 in the table).

Results

TABLE

| Example | Foaming 25° C. ml | behavior 65° C. ml | Foaming behavior in the presence of soil ml (65° C.) | Run-off behavior Drop formation |
|---|---|---|---|---|
| 1 | 40 | 0 | 0 | no |
| 2 | 20 | 0 | 0 | no |
| 3 | 20 | 0 | 0 | no |
| 4 | 40 | 0 | 0 | no |
| 5 | 30 | 0 | 0 | no |
| 6 | 40 | 0 | 0 | no |
| 7 | 30 | 0 | 0 | no |
| 8 | 10 | 0 | 0 | no |
| 9 | 10 | 0 | 0 | no |
| 10 | 10 | 0 | 0 | no |

We claim:

1. A detergent composition for the mechanical cleaning of hard surfaces in aqueous alkaline liquors, which comprises (A) 20 to 95% by weight of a nonionic surfactant of the formula

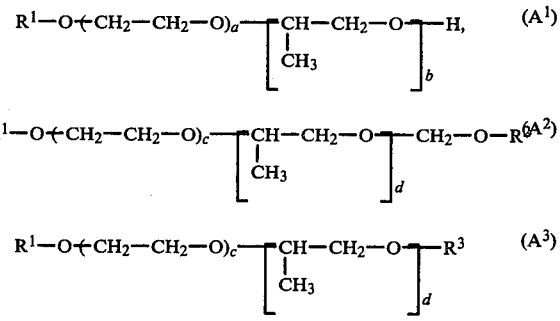

$(A^1)$ $(A^2)$ $(A^3)$ or of a mixture of the formulae $(A^1)$, $(A^2)$ and/or $(A^3)$, in which $R^1$ is an alkyl radical having 6 to 18 C atoms, $R^2$ is an alkyl radical having 1 to 4 C atoms, $R^3$ is an alkyl radical having 1 to 4 C atoms, a is a statistical average value within the range from 3 to 6, b is a statistical average value within the range from 3 to 5, c is a statistical average value within the range from 6 to 12 and d is a statistical average value within the range from 0 to 3, and (B) 5 to 80% by weight of a cationic surfactant of the formula

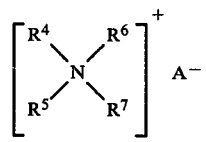

in which $R^4$, $R^5$ and $R^6$ are identical or different and are alkyl radicals having 1 to 8 C-atoms and $R^7$ is an alkyl radical having 1 to 4 C-atoms or a benzyl radical, and A denotes an anion.

2. A detergent composition comprising a surfactant rmixture as claimed in claim 1, which mixture comprises 40 to 85% by weight of the nonionic surfactant (A) and 15 to 60% by weight of the cationic surfactant (B).

3. A method for the mechanical cleaning of hard surfaces, which comprises treating said hard surfaces with an aqueous alkaline cleaning liquor containing an effective amount of the detergent composition as claimed in claim 1.

4. The method of claim 3, wherein the aqueous alkaline liquor has a pH of ≧10.

5. The method of claim 3, wherein the aqueous alkaline liquor has a pH of ≧12.

6. The method of claim 3, wherein the aqueous alkaline cleaning liquor has a pH of at least 10, and the method of treating said hard surfaces includes the step of vigorous mechanical agitation of the aqueous alkaline cleaning liquor.

7. The method of claim 6, wherein the vigorous mechanical agitation takes place in the presence of protein-containing soil and glue and printing ink residues.

8. A detergent composition comprising the surfactant mixture of claim 1 in combination with sufficient sodium hydroxide to adjust the pH of said composition, when in said aqueous alkaline liquor, to at least 10.

9. A detergent composition of claim 8, wherein said pH is at least 12.

* * * * *